US005358209A

United States Patent [19]

Ward

[11] Patent Number: 5,358,209

[45] Date of Patent: Oct. 25, 1994

[54] ANCHORING DEVICE

[76] Inventor: William H. Ward, 273 Hanover St., Costa Mesa, Calif. 92626

[21] Appl. No.: 80,911

[22] Filed: Jun. 22, 1993

[51] Int. Cl.[5] ..... F16M 13/00

[52] U.S. Cl. ..... 248/545; 52/157; 248/530; 248/533; 405/244

[58] Field of Search ..... 405/244, 259.1–259.6; 248/530, 545, 533; 52/157

[56] References Cited

U.S. PATENT DOCUMENTS

| | | | |
|---|---|---|---|
| 2,103,948 | 12/1937 | Jones | 248/530 |
| 2,441,109 | 11/1940 | Carlson . | |
| 2,603,319 | 7/1952 | Dyche | 52/157 |
| 2,628,797 | 6/1951 | Campomar . | |
| 3,736,711 | 6/1973 | Thornbrugh | 52/157 X |
| 4,778,142 | 10/1988 | Roba | 248/530 X |
| 4,819,904 | 4/1989 | Shpigel . | |
| 4,832,304 | 5/1989 | Morgulis | 248/533 |
| 5,046,699 | 9/1991 | Perreault et al. | 248/533 |
| 5,122,014 | 6/1992 | Genfan . | |
| 5,156,369 | 10/1992 | Tizzori | 248/530 X |

FOREIGN PATENT DOCUMENTS

| | | | |
|---|---|---|---|
| 635111 | 2/1962 | Italy | 248/545 |
| 0596694 | 3/1978 | U.S.S.R. | 52/157 |

*Primary Examiner*—Dennis L. Taylor

[57] ABSTRACT

An anchoring device for use on the shaft of a beach umbrella or the like, including a conical member that tapers to a rounded point and around which is spirally wound a constant pitch asymmetric buttress-type thread whose upper surface is perpendicular to the long axis of the conical member.

14 Claims, 2 Drawing Sheets

ANCHORING DEVICE

BACKGROUND OF THE INVENTION

1. Field of the Invention

The ubiquitous beach umbrella has long been an essential part of a day's stay at the beach. This is even more true with the current worries about the deleterious effects of exposure to ultraviolet light. Traditionally, the umbrella was anchored by simply driving the shaft into the sand. For this purpose, the shaft might be equipped with a sharp tip to make insertion easier, but a sharply pointed shaft represents something of a safety hazard. Furthermore, if the substrate is soft, like dry sand, a shaft that is merely pushed into the ground will probably not be inserted deeply enough to withstand the force of prevailing wind on the attached umbrella. On the other hand, if the substrate is more resistant, like wet sand or gravel, it will be very difficult to drive the shaft no a sufficient depth to give adequate support.

2. Description of Related Art

The prior art has attempted to solve this problem by providing a number of different screw-type devices that are attached to the umbrella shaft.

U.S. Pat. No. 2,103,948 to Jones shows a tubular, pointed socket for receiving the end of the umbrella shaft. Around this is a shallow, helical thread. Such a shallow thread provides neither adequate driving force nor sufficient anchoring ability while still having a dangerous point.

U.S. Pat. No. 2,441,109 to Carlson shows a shaft socket which has a pointed "corkscrew" at its lower end and handles to help screw the device into the ground. This unit appears to have the same drawbacks of the prior art, plus the additional complexity of handles.

U.S. Pat. No. 4,832,304 to Morgulis is similar, but the handles are pivotable and form part of the clamping arrangement.

U.S. Pat. No. 5,046,699 to Perreault et al. has fixed handles and a dangerously pointed screw member.

U.S. Pat. No. 2,628,797 uses an eccentric crank, rather like a brace and bit, to drive a twisted screw in a form similar to a wood drill bit.

These inventions all suffer from screw structures that have insufficient surface area on the screw threads to produce adequate force to draw the device deeply into the sand. U.S. Pat. No. 5,122,014 to Genfan attempts to remedy these shortcomings by providing larger driving blades which provide more pull and better anchoring. The device can penetrate the sand despite the large size of the blades because sand is scooped into the hollow shaft. However, such a device is ineffective in gravel or other resistant materials because excessive torque is required to turn the shaft. U.S. Pat. No. 5,088,681 to Procaccianti et al. approaches the problem by providing a broad helical flight attached to a sharply pointed elongate member. The flight would provide sufficient driving force and, area for anchoring, but would require excessive torque in a hard substrate as the broad helical flight must be forced through the resistant material.

Apparently the prior art is not fully effective. Sharply pointed stakes present a hazard to the user. Most of the prior art devices lack spiral threads of sufficient lateral extent to draw the device into a resistant substrate and to provide sufficient anchoring against prevailing winds. Those devices that do have threads of sufficient lateral extent are extremely hard to turn in resistant substrates, even with the additional complexity of special handles for the application of force.

OBJECTS AND SUMMARY OF THE INVENTION

It is an object of the present invention to provide a structure that will strongly pull itself into a variety of substrates both resistant and soft, such as wet or dry sand or fine gravel.

It is a further object to provide a device is capable of pulling the shaft to a sufficient depth, in a variety of substrates, so that the shaft will adequately resist lateral motion.

A still further object is to provide a device that can be easily attached to an umbrella shaft or other shafts to allow ready insertion of the shaft into a variety of substrates without the need for handles or other force augmenting devices.

Another object is to provide a device that can be readily manufactured and requires little or no maintenance.

Another object is to provide a safe device without an extremely pointed tip.

These and other objects of the present invention are particularly accomplished by a novel screw auger with a clamp allowing easy attachment to an umbrella shaft or the like. The screw is conical with an asymmetrical buttress-type thread. The upper surface of the thread is perpendicular to the axis of the screw. The cone tapers to a rounded tip, while the depth of the thread maintains a constant ratio with the outer diameter of the cone.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DETAILED DESCRIPTION OF THE PREFERRED EMBODIMENTS

The following description is provided to enable any person skilled in the field of anchor devices to make and use the present invention, and sets forth the best mode contemplated by the inventor for carrying out his invention. Various modifications, however, will remain readily apparent to those skilled in the art, since the generic principles of the present invention have been defined specifically to provide an improved anchor device for a beach umbrella and the like.

Figure 1:
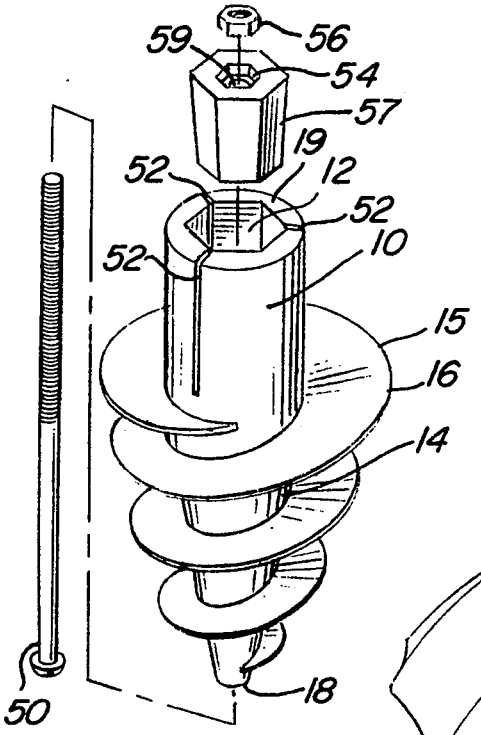
FIG. 1 is a perspective view of the invention.

FIG. 1 shows the invention in a perspective view. Uppermost is the cylindrical base member 10 with its hexagonal tapering interior lumen 12. The wall 19 of the base member is breached by three equally-spaced slots 52 which in cross-section (see FIG. 3) can be seen to pass through three of the vertices of the hexagon. A tapering plug member 57 which is hexagonal in cross-section fits snugly into the lumen. Recess 54 is provided on the top surface of the plug member 57 to retain the nut 56. A cylindrical bore 58 (see FIG. 4) sized to fit bolt 50 is drilled from rounded tip 18 into the hexagonal lumen. The base member is continuous with the conical member 14 around which is spirally wrapped, at a constant pitch, the asymmetric buttress-type thread 16. The thread is wrapped around the conical member for about four complete revolutions. The depth of the thread maintains a constant proportional relation to the diameter of the conical member decreasing with that diameter as the thread reaches the rounded tip 18. The thread has an upper surface 15 which is approximately perpendicular to the long axis of the anchor device. The lower surface of the thread 17 forms an angle of about 30° degrees with a plane perpendicular to the long axis of the device (see FIG. 4).

Figure 2:
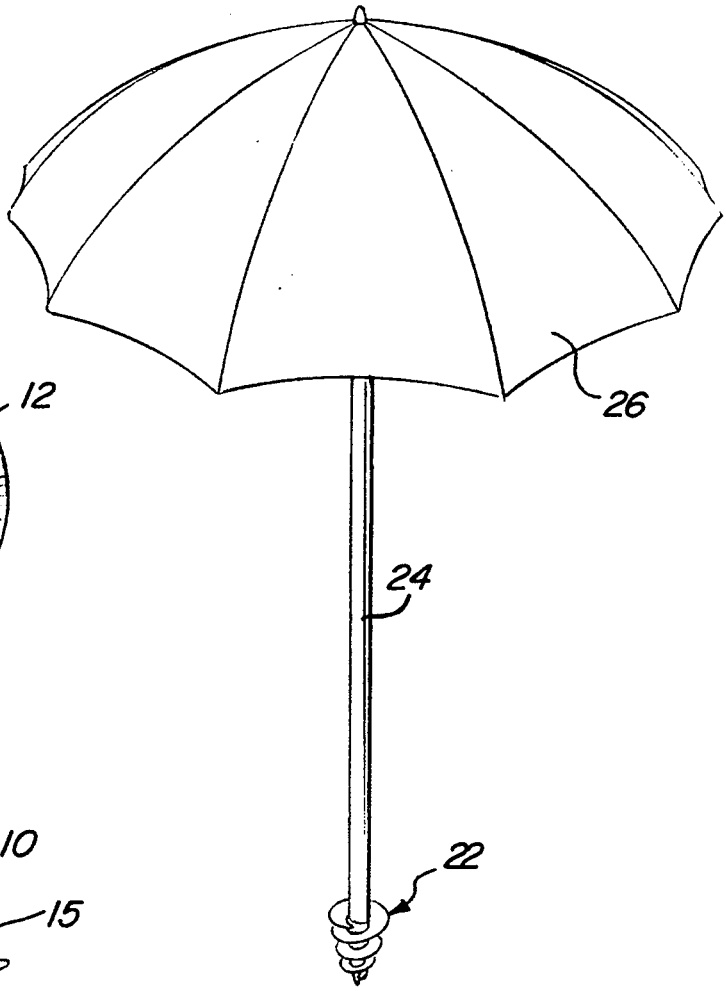
FIG. 2 is a perspective view of the invention attached to the shaft of an umbrella.

FIG. 2 shows the anchor device 22 attached to the shaft 24 of an umbrella with an open canopy 26. In the preferred embodiment the base member is just small enough in diameter to be inserted into a hollow umbrella shaft. The device is secured to the shaft by expanding the hollow base member to grip the shaft as is explained below in reference to FIG. 4. Alternatively, the shaft can be reversibly attached with a pin placed through a hole drilled in the shaft and the device or with some other mechanical linkage.

Figure 3:
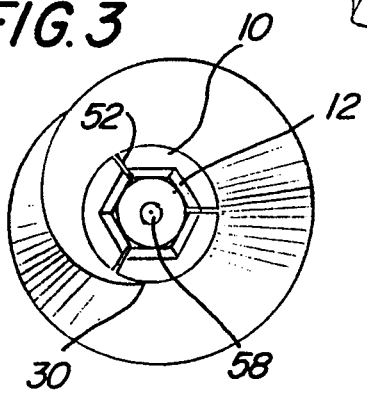
FIG. 3 is a top view of the invention.

FIG. 3 shows a top view of the anchor device. The relation between the base member 10 and the hexagonal lumen 12 is readily apparent. Bore 58 which leads from the rounded tip into the hexagonal lumen is shown. The origin 30 of the asymmetric buttress-type thread from the side of the base member can also be seen. The lumen at its widest point has a width of about 0.75 the diameter of the cylindrical base member. The base member has a diameter of approximately 0.5 that of the entire device at its widest point.

Figure 4:
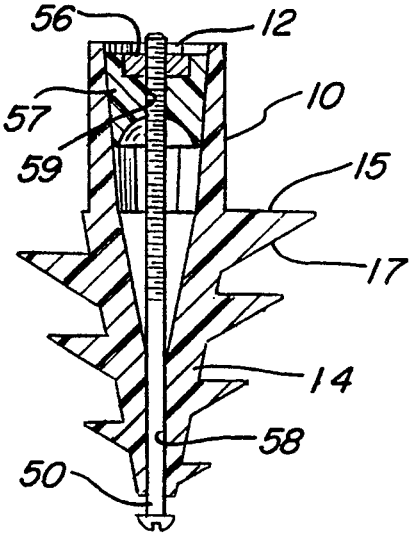
FIG. 4 is a cross-section of the device.

FIG. 4 shows a cross-section of the invention showing how tapered plug member 57 is inserted into the hexagonal lumen 12 and bolt 50 is inserted into bore 58 in the conical member and passes through passageway 59 in the tapered plug member 57. Nut 56 engages bolt 50 and is retained from rotation by recess 54. The device is attached to the shaft by inserting the base member into the hollow opening at the bottom end of the shaft. Then bolt 50 is rotated, causing nut 56 to travel along the threads of the bolt 50 towards the tip 18 of the anchoring device. This pulls the tapered plug member towards the tip 18. The tapering sides of the plug member press against the tapering walls of the lumen. The angling of the walls causes a component of the downward force generated by the bolt and nut to be translated into a lateral force, thereby exerting a force against tapering walls of the lumen. The slots 52 allow the walls to flex in an outward direction, effectively increasing the diameter of the base member causing it to press against the inside wall of the umbrella shaft, thereby anchoring it to the shaft. The upper surface 15 of the asymmetric buttress-type thread is substantially perpendicular to the longitudinal axis of the conical member, while the lower surface 17 of the thread forms an angle of 30° degrees with a plane perpendicular to the axis of the conical member. The proportions of the preferred embodiment can be seen. The conical member tapers from its widest point to a rounded tip over a distance of approximately two diameters of the base member. The spirally-wound, constant pitch, asymmetric buttress-type thread decreases in depth as the diameter of the conical member decreases to maintain a constant ratio of approximately 0.7 with the diameter of the conical member at that point.

Since the device tapers to a rounded tip which is effectively further broadened by the thread, the device does not present a safety hazard. Furthermore, the unit is preferentially molded out of a hard, but somewhat resilient plastic material, rather than being fabricated out of metal. This further reduces the dangers of sharp edges or points. The plastic unit will operate optimally in wet or dry sand, fine gravel, or similar loosely-packed soils. It is not designed to penetrate rock or extremely dense and compacted soil. One skilled in the art will appreciate that the device will be sized to fit shaft diameters and umbrella sizes. The preferred embodiment device to hold a six-foot-diameter umbrella with a 1.0-inch-diameter shaft in beach sand will have a thread depth of about 0.5 inches at the device's widest point.

The device has two modes of operation. In loose materials like dry sand or fine gravel, it acts as an ordinary screw and advances about one thread pitch unit per turn. In tightly-packed materials such as wet sand, the device operates in a boring mode which takes several turns to advance one thread pitch unit while shearing off, loosening, and lifting the packed material.

Figure 7:
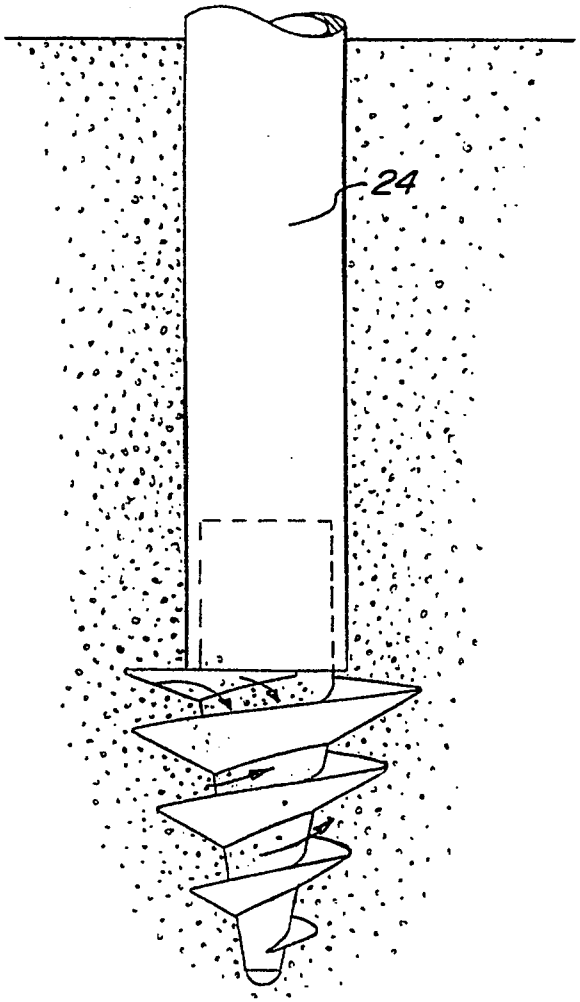
FIG. 7 shows the device burrowing into the substrate so that the device is completely buried.
Figure 6:
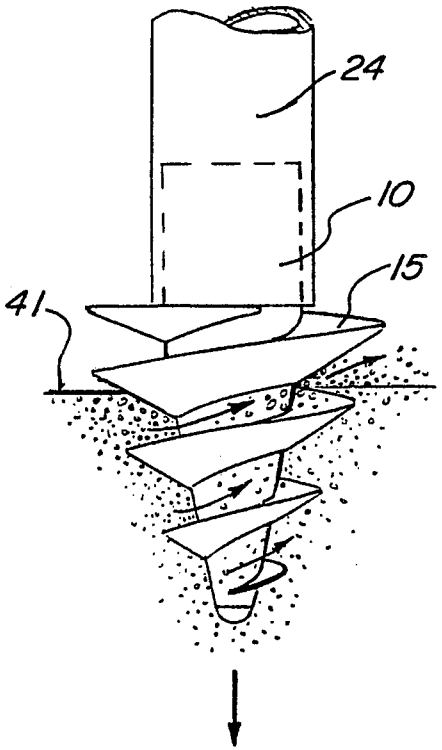
FIG. 6 shows the device burrowed into a substrate almost to the top of the spiral thread.
Figure 5:
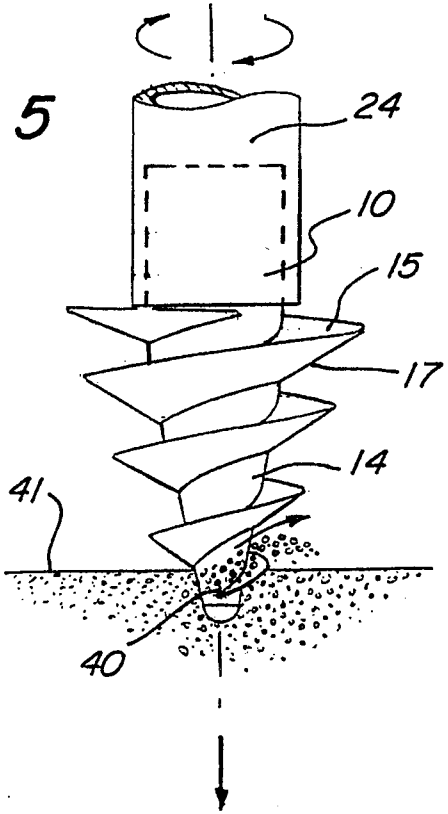
FIG. 5 shows the device just starting to drill its way into a suitable substrate.

The boring mode can be better understood by reference to FIG. 5, which shows the device just starting to bore into a packed substrate. As the device rotates, the upper surface of the smallest turn of the tapered thread 40 shears off a thin layer of the material, loosening and slidingly lifting it. The weight of the device and the shaft, as well as the pull of the screw, causes the device to advance into the newly excavated opening. This is shown in FIG. 6. Because the thread constantly increases with distance from the tip, a similar thickness of material is sheared off along the entire length of the thread that is embedded in the substrate. The material is slidingly lifted along the spiral groove of the screw and deposited on the surface 41 of the substrate. Eventually, as in FIG. 7, the screw thread is completely buried. The device continues to advance and the loosened material is lifted and packed behind the largest thread to ensure that the device is securely buried to provide a maximally effective anchor. Because the top surface of the thread is perpendicular to the axis of the cone, the device is able to rotate when buried without exerting any outward force on the lifted material. This substantially reduces the torque necessary to rotate the device and makes handles superfluous.

Those skilled in the art will readily appreciate that various adaptations and modifications of the just-described preferred embodiment can be configured without departing form the scope and spirit of the invention. Therefore, it is to be understood that, within the scope of the appended claims, the invention may be practiced other than as specifically described herein.

What is claimed is:

1. A device for anchoring a hollow shaft of a beach umbrella and the like comprising:

a cylindrical base member sized to fit within the hollow shaft, the member having an tapering interior lumen;

a conical member continuous with an end of the base member and tapering to a rounded tip, the conical member containing a tapering lumen continuous with the lumen of the base member;

an asymmetric buttress-type thread spirally wound around the conical member, the depth of the thread decreasing with the diameter of the conical member to maintain an approximately constant ratio with the diameter of the conical member, the thread having an upper surface facing towards the base member and a lower surface facing towards the rounded tip of the conical member, the upper surface being substantially perpendicular to the longitudinal axis of the conical member, and the lower surface forming an angle of between about 20° and 60° degrees with a plane perpendicular to the longitudinal axis of the conical member; and means for attaching the anchoring device to the shaft of a beach umbrella and the like.

2. The device of claim 1 where the constant ratio is between 0.5 and 0.9.

3. The device of claim 1 where the base member is inserted into the hollow end of the shaft, a hole is drilled into the shaft and the base member, and a mechanical fastener is inserted into the hole thereby attaching the device to the shaft.

4. The device of claim 1 where the attachment means comprises:

a bolt;

a nut that is sized to fit the bolt;

a tapering plug member, sized to fit within the interior lumen, inserted into the lumen, the plug member having a first surface that is larger in cross-section than a second surface, a passageway from the first surface to the second surface sized to allow the passage of the bolt, and means to prevent the nut from turning relative to the base member; and a bore leading from the rounded tip of the conical member to the interior lumen, the bore sized to fit the bolt so that the bolt may be inserted into the bore, and through the passageway in the tapered plug to engage the nut, whereby turning the bolt draws the tapered plug towards the rounded tip expanding the diameter of the base member thus attaching the device to the shaft.

5. The device of claim 1 where the tapering of the conical member occur over a distance of approximately 1.5 to 4 times the diameter of the base member.

6. The device of claim 1 where the thread is wound around the conical member between three and six times.

7. A device for anchoring a hollow shaft of a beach umbrella and the like comprising:

a bolt;

a nut that is sized to fit the bolt;

a cylindrical base member sized to fit within the hollow shaft, the member having an tapering interior lumen that is hexagonal in cross-section;

three slots breaching the cylindrical base member spaced approximately an equidistance apart around the circumference of the member;

a tapering plug member that is hexagonal in cross-section, sized to fit within the tapering interior lumen, and inserted into the lumen, the plug member having a first surface that is larger in cross-section than a second surface, a passageway from the first surface to the second surface sized to allow the passage of the bolt, and a recess in the first surface sized co accept the nut into which the nut is inserted;

a conical member continuous with an end of the base member and tapering to a rounded tip with a diameter approximately one-fourth the diameter of the base member, the tapering occurring over a distance of approximately two times the diameter of the base member, the conical member containing a tapering, hexagonal cross-sectioned lumen continuous with the lumen of the base member;

an asymmetric buttress-type thread spirally wound about four times around the conical member, the depth of the thread decreasing with the diameter of the conical member to maintain a ratio of approximately 0.7 with the diameter of the conical member, the thread having an upper surface facing towards the base member and a lower surface facing towards the rounded tip of the conical member, the upper surface being substantially perpendicular to the longitudinal axis of the conical member, and the lower surface forming an angle of approximately 30 degrees with a plane perpendicular to the longitudinal axis of the conical member; and a bore leading from the rounded tip of the conical member to the interior lumen, the bore sized to fit the bolt so that the bolt may be inserted into the bore, and through the passageway in the tapered plug to engage the nut.

8. A device for anchoring a shaft of a beach umbrella and the like comprising:

a conical member tapering to a rounded tip;

an asymmetric buttress-type thread spirally wound around the conical member, the depth of the thread decreasing with the diameter of the conical member to maintain an approximately constant ratio with the diameter of the conical member, the thread having an upper surface facing away from the rounded tip and a lower surface facing towards the rounded tip of the conical member, the upper surface being substantially perpendicular to the longitudinal axis of the conical member, and the lower surface forming an angle of between about 20° and 60° degrees with a plane perpendicular to the longitudinal axis of the conical member; and means for attaching the anchoring device to the shaft of a beach umbrella and the like.

9. The device of claim 8 where the constant ratio between the depth of the thread and the diameter of the conical member is between 0.5 and 0.9.

10. The device of claim 8 where the means for attaching the device to a hollow shaft comprises:

a cylindrical base member continuous to an end of the conical member opposite to the rounded tip, the cylindrical base member inserted within the hollow shaft;

a hole through the shaft and into the base member; and a mechanical fastener inserted into the hole thereby attaching the device to the shaft.

11. The device of claim 10 where the mechanical fastener is selected from a group comprised of a screw, a nail, a bolt and a rivet.

12. The device of claim 10 where the tapering of the conical member occurs over a distance of approximately 1.5 to 4 times the diameter of the base member.

13. The device of claim 8 where the thread is wound around the conical member between two and six times.

14. The device of claim 8, wherein the means for attaching the conical member to the shaft comprises a fastener between a surface of the conical member opposite the rounded tip and an end of the shaft.

* * * * *